US006779820B2

(12) United States Patent
Ogino

(10) Patent No.: US 6,779,820 B2
(45) Date of Patent: Aug. 24, 2004

(54) LATCH DEVICE FOR VEHICLE TAILGATE

(75) Inventor: Miki Ogino, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/115,260

(22) Filed: Apr. 4, 2002

(65) Prior Publication Data

US 2002/0158473 A1 Oct. 31, 2002

(30) Foreign Application Priority Data

Apr. 4, 2001 (JP) ..... 2001-106543

(51) Int. Cl.[7] ..... E05C 3/06
(52) U.S. Cl. ..... 292/216; 292/DIG. 29
(58) Field of Search ..... 292/216, DIG. 29, 292/DIG. 3, 11, 56

(56) References Cited

U.S. PATENT DOCUMENTS 2,926,943 A * 3/1960 Leslie
3,146,021 A * 8/1964 Ericson ..... 292/106
3,337,993 A * 8/1967 Seggern ..... 49/72
3,645,043 A * 2/1972 Velvicius ..... 49/370
4,157,844 A * 6/1979 Sarosy ..... 292/48
6,017,067 A * 1/2000 Yoneyama ..... 292/216
6,123,386 A * 9/2000 Montone ..... 296/146.8

* cited by examiner

*Primary Examiner*—Gary Estremsky
(74) *Attorney, Agent, or Firm*—Browdy and Neimark, P.L.L.C.

(57) ABSTRACT

A latch device for a vehicle tailgate having a main door and a sub door, comprises a latch lever moving from an initial position to an operating position by a contact with a sub latch, a return spring urging the latch lever from the operating position toward the initial position, and a block lever connected to the latch lever. The block lever is displaced to a blocked position where the door-opening of the main door by the main open handle is impossible when the latch lever is restored to the initial position by the return spring and to be displaced to an unblocked position where the door-opening of the main door by the main open handle is possible when the latch lever is moved to the operating position by the contact with the sub latch against the elasticity of the return spring.

3 Claims, 3 Drawing Sheets

Fig. 1
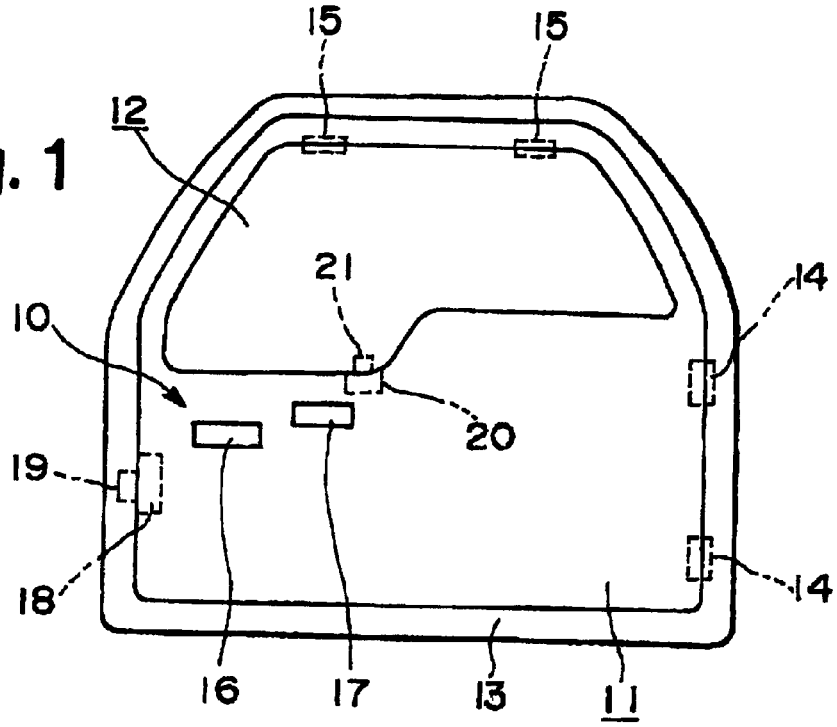
Fig. 4
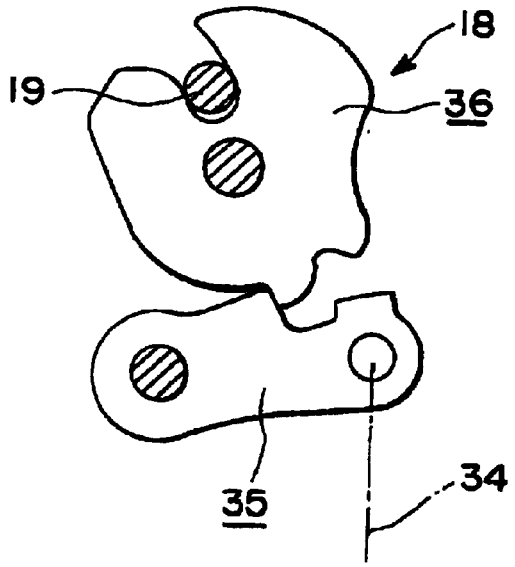
Fig. 6
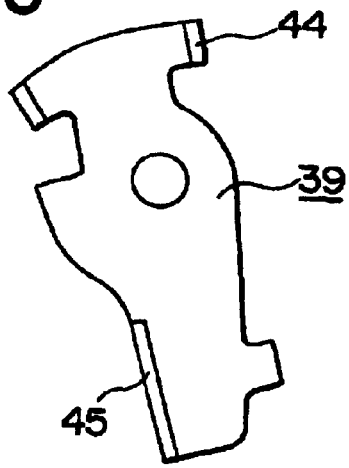
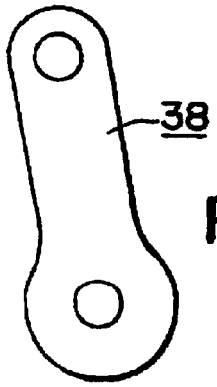
Fig. 5

LATCH DEVICE FOR VEHICLE TAILGATE

BACKGROUND OF THE INVENTION

1. Field of the Invention

The present invention relates to a latch device for a vehicle tailgate having two doors, that is, a main door and a sub door.

2. Description of the Related Art

In the case of a tailgate having a main door and a sub door, from the viewpoint of the counter measure of safety and the prevention of damage of doors, there are some cases where the door-opening operation of the main door and/or the door-opening operation of the sub door may have some restrictions, and for example, in some cases, it is set that the door-opening operation of the main door is invalid when the sub door is in the open state.

U.S. Pat. No. 6,017,067 shows a typical tailgate latch device which has a main latch unit for keeping a main door in the closed state in cooperation with a main striker and a sub latch unit for keeping a sub door in the closed state in cooperation with a sub striker. A sub ratchet of the sub latch unit is connected to a clutch mechanism which is operatively provided between a main open handle and a main ratchet of the main latch unit. The clutch mechanism disconnects the main open handle from the main ratchet when the sub ratchet releases the sub latch of the sub latch unit.

The problem of the conventional latch device is in the point that the clutch mechanism is switched between the connected state and the unconnected state by the movement of the sub ratchet. The sub ratchet moves to be engaged with the sub latch by the elasticity of a ratchet spring, and it moves to be separated from the sub latch by the door-opening operation force of the sub open handle. The ratchet spring should have a comparatively strong elasticity so that it can make the sub ratchet engage with the sub latch instantaneously in response to the door-closing of the sub door. Additionally, it is necessary for the ratchet spring to have a force for moving plural parts of the clutch mechanism when moving the sub ratchet toward the sub latch, and therefore, the elasticity of the ratchet spring is set to be stronger. Such a strong ratchet spring hurts the good operational feeling of the sub open handle.

SUMMARY OF THE INVENTION

Accordingly, it is an object of the present invention to provide a latch device for a vehicle tailgate, wherein the above described problem is overcome by detecting the opening state of the sub door on the basis of the rotational position of the sub latch of the sub latch unit.

Furthermore, it is another object of the present invention to provide a latch device for a vehicle tailgate, wherein the sub door can be closed with no problem even when the door-opening operation of the main door is proceeding.

BRIEF DESCRIPTION OF THE DRAWINGS

FIG. 1 is a rear view of a vehicle tailgate to which a latch device according to the present invention is attached;

FIG. 4 is a schematic view showing a main latch unit of the latch device;

FIG. 5 is a rear view of a sub latch lever of the latch device; and

FIG. 6 is a rear view of the block lever.

DESCRIPTION OF THE PREFERRED EMBODIMENT

Figure 2:
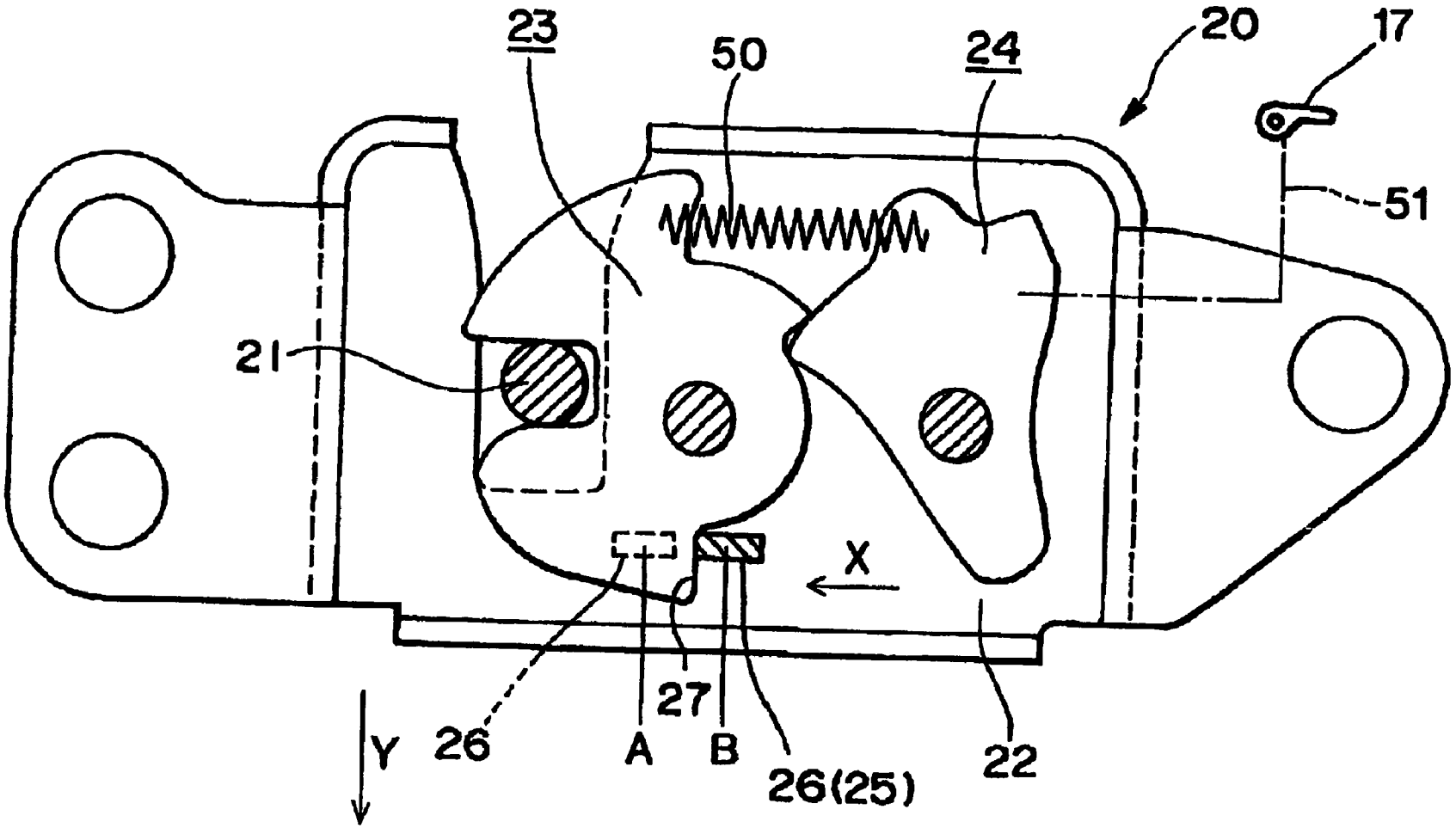
FIG. 2 is a bottom view of a sub latch unit of the latch device.

FIG. 1 shows a latch device 10 according to the present invention, which is attached to a vehicle tailgate. The tailgate has a main door 11 which is attached to a vehicle body 13 with hinges 14 and a sub door 12 which is attached to the main door 11 with hinges 15. The construction of the tailgate is optional, and only one example is shown in FIG. 1.

The latch device 10 has two latch units 18, 20 and two strikers 19, 21. The main latch unit 18 attached to the main door 11 keeps the main door 11 in the closed state in cooperation with the main striker 19 fixed to the vehicle body 13. The sub latch unit 20 attached to the main door 11 keeps the sub door 12 in the closed state in cooperation with the sub striker 21 fixed to the sub door 12. A main open handle 16 for opening the main door 11 and a sub open handle 17 for opening the sub door 12 are provided onto the outside surface of the main door 11.

The main latch unit 18 has, as shown in FIG. 4, a main latch 36 which is engageable to the main striker 19 and a main ratchet (pawl lever) 35 which keeps the engaged state between the main latch 36 and the main striker 19 by being engaged with the main latch 36. As described later, the door-opening operation of the main open handle 16 under the closed state of the sub door 12 causes the main ratchet 35 to be disengaged from the main latch 36 to release the engaged state between the main latch 36 and the main striker 19.

As shown in FIG. 2, the sub latch unit 20 has a sub latch 23 which is engageable with the sub striker 21 and a sub ratchet (pawl lever) 24 which keeps the engaged state between the sub latch 23 and the sub striker 21 by being engaged with the sub latch 23. The sub latch 23 and the sub ratchet 24 are pivoted to a base body 22 of the sub latch unit 20. The sub latch 23 is urged in the clockwise direction toward the unlatched position by the elasticity of a latch spring 50. The sub ratchet 24 is connected to the sub open handle 17 through connecting means 51 such as a rod.

Figure 3:
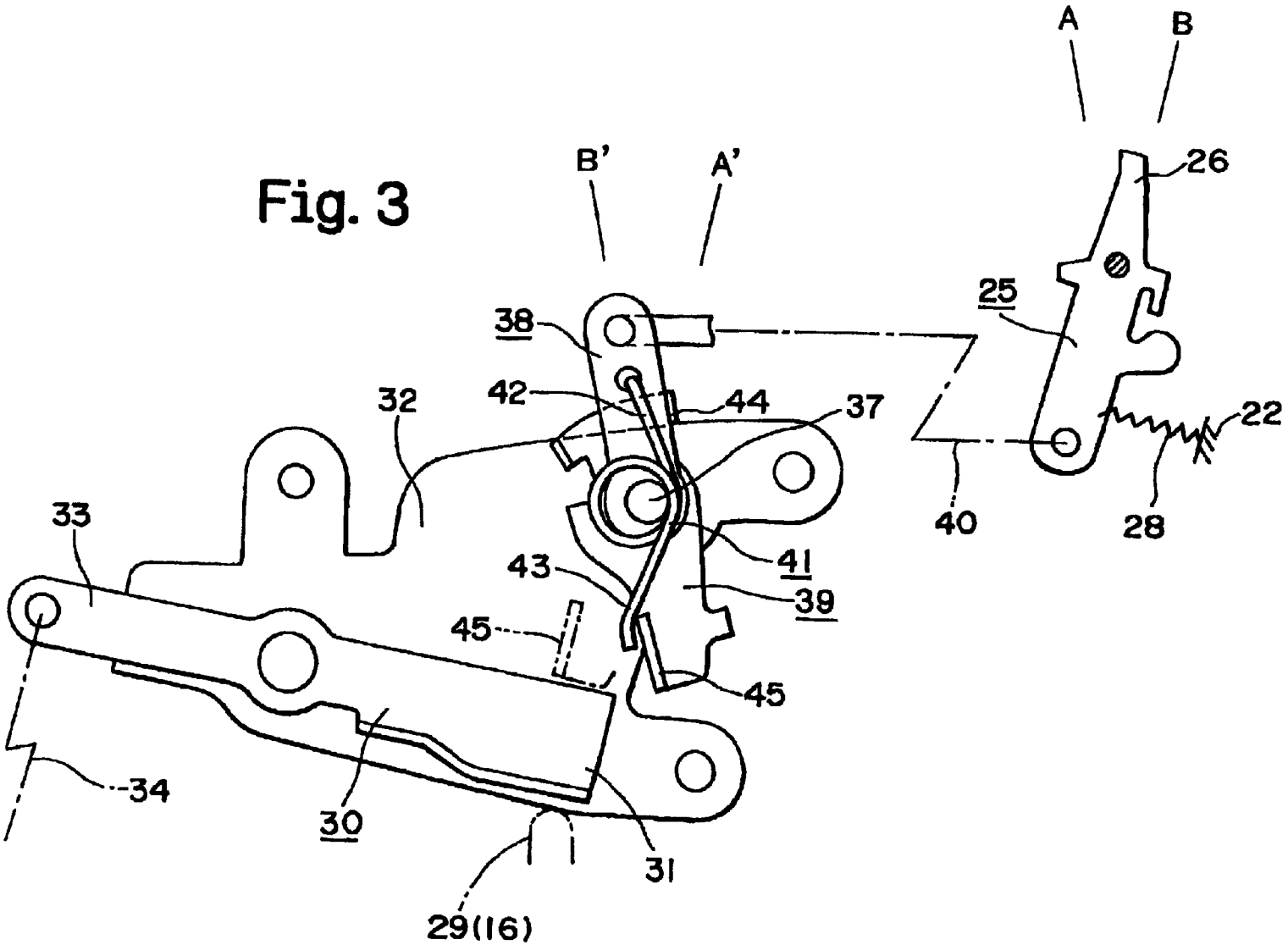
FIG. 3 is a rear view showing the relation between a block lever and an open lever of the latch device.

As shown in FIGS. 2 and 3, the sub latch unit 20 further has a first latch lever 25 which is pivoted to the base body 22. An engaging end 26 of the first latch lever 25 is urged in the direction shown by arrow X in FIG. 2 by the elasticity of a return spring 28 (FIG. 3), and when the sub latch 23 is put in the unlatched position by the elasticity of the latch spring 50, the engaging end 26 is kept in the initial position A shown by the dotted line in FIG. 2. When the sub latch 23 is rotated from the unlatched position to the latched position in FIG. 2 by the door-closing of the sub door 12, a contact surface 27 of the sub latch 23 comes into contact with the engaging end 26 to move the engaging end 26 to the operating position B shown by a cross section in FIG. 2.

In FIG. 3, a contact end 29 of the main open handle 16 is shown by a virtual line. The contact end 29 moves upward in FIG. 3 according to the door-opening operation of the main open handle 16. On the movement locus of the contact end 29, a first end 31 of an open lever 30 is positioned. The open lever 30 is pivoted onto a bracket 32 which is attached to the main door 11, and a second end 33 of the open lever 30 is connected to the main ratchet 35 of the main latch unit 18 through a rod 34.

To the bracket 32, a second latch lever 38 and a block lever 39 are pivoted by a single common supporting shaft 37. The second latch lever 38 is connected to the first latch lever 25 through a rod 40 to be displaced integrally with the first latch lever 25, and accordingly, the second latch lever 38 is also displaced between the initial position A' and the operating position B' according to the movement of the sub latch 23. A connecting spring 41 operatively connecting the second latch lever 38 and the block lever 39 has a first leg part 42 which is engaged with the second latch lever 38 and a second leg part 43 which comes into contact with a block part 45 of the block lever 39. The elasticity of the connecting spring 41 urges the block lever 39 in the counterclockwise direction in FIG. 3, and normally, a bent piece 44 of the block lever 39 comes into contact with the side portion of the second latch lever 38.

When the sub latch 23 is rotated from the latched position to the unlatched position by the door-opening of the sub door 12, the latch levers 25, 38 are switched from the operating positions B, B' to the initial positions A, A', respectively, and the block lever 39 is displaced from the unblocked position shown by the solid line in FIG. 3 to the blocked position shown by the dotted line. A block part 45 at the unblocked position is put out of the rotation locus of the first end 31 of the open lever 30, and therefore, it does not prevent the counterclockwise rotation, namely, the door-opening rotation of the open lever 30. However, the block part 45 at the blocked position is positioned on the rotation locus of the first end 31 so that it can restricts the door-opening rotation of the open lever 30.

Operation

When closing the sub door 12, the sub latch 23 of the sub latch unit 20 is displaced to the latched position shown in FIG. 2 by the engagement with the sub striker 21, and the engaging end 26 of the first latch lever 25 is displaced to the operating position B by the contact with the contact surface 27 of the sub latch 23, and the second latch lever 38 connected to the first latch lever 25 with the rod 40 is also displaced to the operating position B'. Furthermore, the block lever 39 is moved to the unblocked position where the block part 45 is put out of the rotation locus of the first end 31 of the open lever 30 according to the displacement of the second latch lever 38 by the elasticity of the connecting spring 41. Therefore, in the state where the sub door 12 is closed, when the turning end 29 of the main open handle 16 comes into contact with one end 31 of the open lever 30 by the door-opening operation of the main open handle 16, the open lever 30 is rotated in the door-opening direction without receiving interference of the block part 45, and consequently, the main ratchet 35 of the main latch unit 18 is disengaged from the main latch 36, and the main door 11 becomes open.

When the door-opening operation is applied to the sub open handle 17, the sub ratchet 24 of the sub latch unit 20 is rotated in the clockwise direction in FIG. 2 to be disengaged from the sub latch 23. Then, the sub door 12 is, normally, pushed out in the door-opening direction (direction shown by arrow Y) by the elasticity of the latch spring 50 and the force of repulsion of weather-strip, and the sub latch 23 is restored from the latched position to the unlatched position, and the engaging end 26 of the first latch lever 25 is restored from the operating position B to the initial position A shown by the dotted line with the elasticity of the return spring 28. Furthermore, the second latch lever 38 is also restored from the operating position B' to the initial position A'. Then, the block lever 39 is switched to the blocked position by the contact between the bent piece 44 and the latch lever 38, and the block part 45 of the block lever 39 is moved to the rotation locus of the first end 31 of the open lever 30. In this blocked state, the door-opening rotation of the open lever 30 is restricted by the block part 45, and therefore, the door-opening operation of the main open handle 16 cannot release the engagement between the main latch unit 18 and the main striker 19. Thus, when the sub door 12 is in the open state, that is, when the sub latch 23 is in the unlatched position, the door-opening of the main door 11 is prevented.

There are some cases where the sub door 12 is not pushed out in the door-opening direction even when the sub ratchet 24 of the sub latch unit 20 is disengaged from the sub latch 23 by the door-opening operation of the sub open handle 17, because of such a reason that the sub door 12 freeze to the main door 11. However, the block lever 39 of the present invention is switched between the blocked position and the unblocked position according to the position of the sub latch 23 regardless of the door-opening operation of the sub open handle 17, and therefore, the opening state of the sub door 12 is not detected by mistake.

Plural members 25, 38, 39 or the like which detect the rotational position of the sub latch 23 to restrict the door-opening of the main door 11 are restored to the initial position (or the blocked position) by the elasticity of the return spring 28. The elasticity of this return spring 28 acts as a force for restoring the sub latch 23 from the latched position to the unlatched position when transmitted to the sub latch 23 through the first latch lever 25. This means that the return spring 28 functions as the assistant for the latch spring 50. Furthermore, the return spring 28 produces no resistance when the sub ratchet 24 is separated from the sub latch 23. Accordingly, the return spring 28 of the latch device 10 of the present invention has no bad effect on the operational feeling of the sub open handle 17.

When the door-opening operation of the main open handle 16 is performed under the open state of the sub door 12, the first end 31 of the open lever 30 comes into contact with the block part 45 of the block lever 39, as mentioned above. The door-closing operation of the sub door 12 in the state where the first end 31 is brought into contact with the block part 45 is included in abnormal operations. If such an abnormal operation is performed, the latch levers 25, 38 are displaced to the operating positions B, B'. At this moment, the connecting spring 41 of the present invention permits the second latch lever 38 to be displaced into the operating position B' while leaving the block lever 39 at the blocked position. Accordingly, even if an abnormal operation is performed, the door-closing of the sub door 12 is smoothly performed, and it is prevented to bring a damage to the contact part of the block lever 39 and the open lever 30.

What is claimed is:

1. A latch device for a vehicle tailgate having a main door and a sub door, comprising:

a main latch unit arranged to keep the main door in a closed state by being engaged with a main striker, said main latch unit having a main latch engageable with the main striker and a main ratchet keeping an engaged state between the main latch and the main striker by being engaged with the main latch;

a main open handle arranged to release the main latch unit from the main striker to open the main door;

a sub latch unit arranged to keep the sub door in a closed state by being engaged with a sub striker, said sub latch unit having a sub latch engageable with the sub striker and a sub ratchet keeping an engaged state between the sub latch and the sub striker by being engaged with the sub latch;

a sub open handle arranged to release the sub latch unit from the sub striker to open the sub door;

a latch lever provided adjacent to the sub latch and moved from an initial position to an operating position by a contact with the sub latch when the sub latch is rotated from an unlatched position to a latched position;

a return spring arranged to urge the latch lever from the operating position toward the initial position;

a block lever connected to the latch lever to be displaced to a blocked position where the door-opening of the main door by the main open handle is impossible when the latch lever is restored to the initial position by the elasticity of the return spring and to be displaced to an unblocked position where the door-opening of the main door by the main open handle is possible when the latch lever is moved to the operating position by the contact with the sub latch against the elasticity of the return spring; and a connecting spring operatively provided between the latch lever and the block lever, wherein said connecting spring permits the latch lever to be displaced from the initial position to the operating position by the contact with the sub latch while leaving the block lever at the blocked position, by being elastically deformed.

2. The latch device for a vehicle tailgate according to claim 1, wherein the return spring has an action of restoring the sub latch from the latched position toward the unlatched position.

3. The latch device for a vehicle tailgate according to claim 2, further comprising an open lever arranged to disengage the main ratchet from the main latch when rotated by the door-opening operation of the main open handle, wherein said block lever at the blocked position makes a door-opening rotation of the open lever impossible by a mechanical contact with the open lever.

* * * * *